US008533888B2

(12) United States Patent
Kessler

(10) Patent No.: US 8,533,888 B2
(45) Date of Patent: Sep. 17, 2013

(54) SHOE CLEANING DOORMAT DEVICE

(76) Inventor: Jack Kessler, Seffner, FL (US)

( * ) Notice: Subject to any disclaimer, the term of this patent is extended or adjusted under 35 U.S.C. 154(b) by 162 days.

(21) Appl. No.: 13/214,139

(22) Filed: Aug. 19, 2011

(65) Prior Publication Data

US 2012/0042460 A1 Feb. 23, 2012

Related U.S. Application Data

(60) Provisional application No. 61/375,274, filed on Aug. 20, 2010.

(51) Int. Cl.
*A47L 23/26* (2006.01)

(52) U.S. Cl.
USPC ..... 15/104.92; 15/215; 15/216

(58) Field of Classification Search
USPC ..... 15/215, 216, 104.92, 237, 238
See application file for complete search history.

(56) References Cited

U.S. PATENT DOCUMENTS

| | | | | |
|---|---|---|---|---|
| 5,297,309 | A | 3/1994 | Rotoli | |
| 5,771,528 | A * | 6/1998 | Nappi, Sr. | 15/311 |
| 5,881,427 | A * | 3/1999 | Offner | 15/215 |
| 5,996,160 | A | 12/1999 | Pruitt | |
| 6,417,778 | B2 | 7/2002 | Blum | |
| 2004/0078909 | A1 * | 4/2004 | Coppa | 15/104.92 |
| 2008/0104782 | A1 | 5/2008 | Hughes | |

* cited by examiner

*Primary Examiner* — Shay Karls
(74) *Attorney, Agent, or Firm* — Daniel Boudwin

(57) ABSTRACT

A shoe cleaning doormat device is provided for cleaning and disinfecting the soles of shoes and feet prior to a user's entry into a dwelling or building. The device is a doormat having a cleaning assembly having a disinfecting cleaning material surface and drying portions. Both portions are housed within a mat frame and exposed to a user through cutouts in the mat's upper surface. A disposable roll of moist, disinfecting wipe material provides the cleaning and disinfecting surface. An advancing button is operatively connected to the roll so that a user may obtain an unused portion of the roll by depressing the button. After shoes or feet are cleaned, they can be dried by rubbing on the drying portions of the device, which comprise a removable, moisture-absorbing material.

11 Claims, 3 Drawing Sheets

SHOE CLEANING DOORMAT DEVICE

CROSS REFERENCE TO RELATED APPLICATION

This application claims the benefit of U.S. Provisional Application No. 61/375,274 filed on Aug. 20, 2010, entitled "Wet Mat."

BACKGROUND OF THE INVENTION

1. Field of the Invention

The present invention relates to doormat device and more specifically to a shoe cleaning doormat device for cleaning and disinfecting feet or shoes prior to entry into a dwelling.

During the course of their daily lives, individuals acquire a great deal of dirt on the soles of their shoes. Surfaces such as roads and sidewalks have a high content of food waste, animal excrement, organic decompositions, dirt and debris. This dirt contains harmful bacteria that could pose serious health risks if brought into a household or dwelling. If dirt is not removed prior to entry, it can be tracked into a building and deposited on clean floors. Dirt left on floors results in an unclean appearance and promotes the proliferation of harmful bacteria. Doormats can reduce the risk of unclean floors and bacterial growth by providing a surface that may be rubbed upon to affect the removal of dirt. Entry mats are commonly placed outside the doorways of homes, office buildings and businesses to remove dirt and debris from the soles of shoes prior to an individual's entry into the building; however these devices are typically simple, carpeted or moisture-absorbing surfaces that collect particulate dirt and debris. After continual use, these devices become imbedded with dirt, dust and debris that limit their usefulness when cleaning a user's feet or shoes. These devices would be advanced by the addition of a disinfecting, moistening and drying capability in addition to a simple surface that merely removes of visible dirt and debris particles from a user's feet or shoe soles. These devices would similarly be improved if provided a means to advance a new, unused surface to affect dirt removal after each use.

2. Description of the Prior Art

The prior art contains a variety of shoe-cleaning doormat devices for cleaning and disinfecting the shoes or the feet of a user. These devices have familiar design and structural elements for the purposes of cleaning soles of shoes and feet; however they are not adapted for the task of providing a disposable means for cleaning and disinfecting shoes and feet prior to a user's entry into a dwelling.

Blum et al, U.S. Pat. No. 6,417,778 discloses a floor mat having a base portion and a cleanable insert portion. The cleanable insert portion fits within a recess in the base portion. The floor mat contains a modifiable display portion in either the removable insert or base. This modifiable display may comprise an erasable writing board, an LCD display, electric paper, or other electrical display device. This display is in wireless communication with a computer or network so that a user may remotely modify the message displayed upon the floor mat. In addition to the modifiable display Blum contemplates an antibacterial and antifungal composition within the insert portion or base portion for cleaning a user's shoes. Blum suggests that an antibacterial composition could be sprayed on the mat or integrated into the mat material as pellets or fibers. Blum does not disclose disposable antibacterial wipes as a means for cleaning a user's shoes. A roller mechanism for antibacterial wipes is similarly not contemplated by Blum, nor is an activation button for advancing the roller such that an unused wipe is made available to a user.

Pruitt, U.S. Pat. No. 5,996,160 discloses a doormat comprising a mat frame, a wiping mat portion, a liquid reservoir, a plurality of cylindrical brushes in parallel alignment, a liquid absorbing fabric, and a stretcher for maintaining the same in a taut position. The mat portion is made of stiff fibers so that a user may wipe their shoes on the mat to dislodge dirt and debris. The brushes are secured to interior walls of the liquid reservoir such that a portion of the brush bristles are exposed above the liquid reservoir. At least one of the cylindrical brushes rotates about a central axis. When a user rubs the soles of his or her shoes over the bristles of the brushes, they rotate. Refreshing the brush bristles with liquid and cleaning the soles of the user's shoes. The liquid absorbing fabric is removably retained in a taut configuration by the stretcher.

The wiping mat, the liquid reservoir and the liquid absorbing material are inset into compartments in the mat frame of the device. The liquid absorbing material of Pruitt is not movable and when the fabric becomes soiled it must be removed and replaced by a user, unlike the rotating mechanism of the instant invention that provides a fresh cleaning wipe to a user. Additionally the fabric wipes of Pruitt are used to dry the soles of a user's shoes. Not moisten and disinfect them like moist disinfecting wipes of the present invention.

Rotoli, U.S. Pat. No. 5,297,309 discloses a doormat having a wiping mat portion, a trough insert, a sponge material, and an elastic grating. The trough insert sits within the wiping mat portion and retains disinfecting liquid. Sponge material is housed within the trough, where it absorbs and retains disinfecting liquid. An elastic grating extends to all four edges of the trough, enclosing the sponge material therebetween. When a user rubs his or her shoe across the elastic grating, the grating deforms and permits the shoe to depress the sponge material thereby releasing disinfecting liquid onto the shoe. In this manner pressing and rubbing it upon the elastic grating portion of the doormat may clean a shoe. This device does not include a disposable fabric moist wipe, or a rolling mechanism for providing a user with an unused wipe.

Hughes, U.S. Patent Application Publication No. 2008/0104782 discloses a cleaning and disinfecting device for feet and shoes. The device comprises a main frame assembly, a waste recovery tray, support bars, a rubber mat, and a wand attachment. The rubber mat lies upon the support bars, which extend across the top of the main frame assembly to disperse the weight of a user. In the center of the main frame and attached to the support bars, there are a plurality of brush manifolds for removably retaining a plurality of bristle brushes. A liquid conduit is disposed within each brush manifold and a nozzle secured to the liquid conduit extends from the top of said brush manifold. These bristle brushes extend upward from the manifold, through the rubber mat so that they may contact the bottom of a user's shoe or foot.

Hughes further discloses a fluid injection system sends cleaning or disinfecting liquid through the liquid conduits and into the bristle brushes to facilitate the cleaning and disinfecting of shoes or feet. Used cleaning fluid runs downward into the waste recovery tray. Fluid injection is trigger by a user stepping upon the central area of the cleaning mat device. A wand attachment is tethered to the device and may be used to clean the top of a user's shoes. There is no disclosure of disposable wipes or a roller mechanism for providing an unused wipe to a user. Hughes relies on bristle brushes to clean and disinfect shoes and feet, as opposed to cleaning wipes as described in the present invention.

None of the prior art devices disclose an advancing button operably connected to a roller mechanism to rotate the roller and supply a fresh mat for consecutive users. The devices disclosed by the prior art also do not address the need for a disposable means of cleaning and disinfecting the soles of shoes and feet. The current invention relates to a device for cleaning the soles of shoes or feet a roll of disposable disinfecting wipe, wherein a fresh surface is made available on demand by a user. It substantially diverges in structural elements from the prior art, consequently it is clear that there is a need in the art for an improvement to existing shoe-cleaning doormat devices. In this regard the instant invention substantially fulfills these needs.

SUMMARY OF THE INVENTION

In view of the foregoing disadvantages inherent in the known types of foot and shoe cleaning doormat devices now present in the prior art, the present invention provides a device wherein a roller mechanism comprising moist disinfecting wipes can be utilized for providing convenience for the user when cleaning the soles of her or her shoes or feet prior to entering a dwelling, and for providing a fresh cleaning surface for each use.

The present invention comprises a doormat frame upon which are provided a cleaning assembly roller and two drying positions. Feet or shoes are rubbed across a moist, disinfecting fabric surface presented by the cleaning assembly to remove excess dirt, clean and disinfect a user's feet or shoes. The device may also be utilized by pets, which can be trained to wipe the pads of their feet on the mat before entering a house. Thus, the doormat device assists in reducing the spread of dirt, grime and germs into a dwelling.

The cleaning assembly comprises a dual rollers fitted with a length of disinfecting fabric that is placed in a working position along the upper surface of the mat frame. An advancing button rotates one of the rollers, while the second is free to rotate and unroll a length of the fabric. The disposable roll of disinfecting wipe fabric unrolls from one roll and accumulates on the other after being utilized. The rotating mechanism is housed within the doormat portion and retains the disinfecting wipe fabric in a taut, arcuate state. A useable area of disinfecting wipe protrudes above the surface of the doormat portion so that a user may rub his or her feet upon the wipe. When feet or shoes are rubbed upon the disinfecting wipe surface, dirt is removed from the soles and disinfecting liquid is distributed across the same. To obtain an unused portion of the disinfecting wipe roll, a user depresses the advancing button with his or her feet. The button is operably connected to a rotating mechanism that advances one roll of disinfecting wipe fabric to draw a fresh surface of fabric across the working surface of the doormat.

After a user has cleaned his or her feet on the moist wipe, they may then be wiped on the drying material positioned on a first and second side of the moist wipe area. The drying of the soles of shoes or feet absorbs moisture to reduce the amount of dirt that clings to the bottom of a user's feet after stepping from the mat. The device may be battery operated or alternatively may be manually advanced depending upon the embodiment of rotating mechanism employed. An electric motor and controller operably rotates a first roller to draw fabric and allow the user to access a fresh section of fabric.

The device may be provided in any shape, size and color to accommodate the varied aesthetic tastes of user. Graphic designs may be displayed on the surface of the mat frame. Availability of graphic designs may be dependent on the size and construction of the mat frame. For example, the mat frame may display the words "Welcome Home" and feature images of flowers. In an alternative example, the mat frame may be shaped like an oval with a surface area that permits only the display of the word "Welcome".

It is therefore an object of the present invention to provide a new and improved shoe cleaning doormat device having all the advantage of the prior art and none of the disadvantages.

Another object of the present invention is to provide a new and improved shoe cleaning doormat device providing disposable disinfecting means for a user.

Another object of the present invention is to provide a new and improved shoe cleaning doormat device having a means for providing an unused disinfectant surface to a user every time the device is utilized.

Another object of the present invention is to provide a new and improved shoe cleaning doormat device providing both a moist disinfectant portion for disinfecting the soles of the shoes or feet, and a dry portion for removing moist disinfecting solution from a user's feet or shoes after their cleaning.

Another object of the present invention is to provide a new and improved shoe cleaning doormat device that may be utilized by animals such as domestic dogs or cats, to clean their paws prior to their entry into a dwelling.

Another object of the present invention is to provide a new and improved shoe cleaning doormat device that provides a user with easily replaceable moist disinfecting means.

Yet another object of the present invention is to provide an electric or purely mechanical roller advancing means embodiment for the user to advance the cleaning material.

A further object of the present invention is to provide a new and improved shoe cleaning doormat having resilient and durable construction and foot-operable roller advancing means.

Other objects, features and advantages of the present invention will become apparent from the following detailed description taken in conjunction with the accompanying drawings.

BRIEF DESCRIPTIONS OF THE DRAWINGS

The above invention will be better understood and the objects set forth above as well as other objects not stated above will become more apparent after a study of the following detailed description thereof. Such description makes use of the annexed drawings wherein like numeral references are utilized throughout.

DETAILED DESCRIPTION OF THE INVENTION

Figure 1:
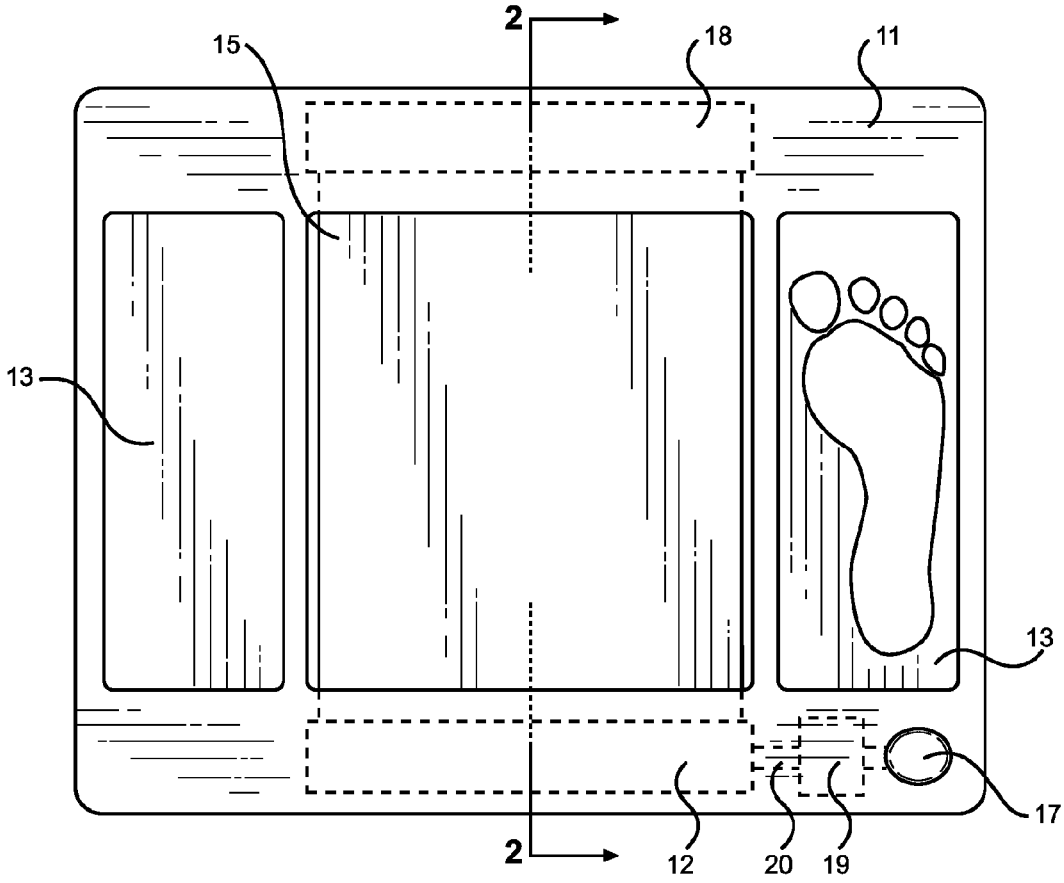
FIG. 1 shows an overhead view of a shoe cleaning doormat device according to the present invention. A footprint is shown to denote placement of a user's foot upon the mat.

Reference is made herein to the attached drawings. Like reference numerals are used throughout the drawings to depict like or similar elements of the shoe-cleaning doormat device. For the purposes of presenting a brief and clear description of the present invention, the preferred embodiment will be discussed as used for cleaning and disinfecting the soles of shoes and feet. This is for representative purposes only and should not be considered to be limiting in any respect.

Referring now to FIG. 1, there is shown a top view of the present shoe-cleaning doormat device. The device comprises a mat frame 11, a cleaning assembly comprising a roll of cleaning material 15 and an advancing means, along with a pair of laterally disposed drying portions 13. The mat frame 11 comprises the body of the device and houses the cleaning assembly and drying portions 13 therein. These portions are exposed to a user through cutouts in the top surface of the mat frame 11. A cutout is positioned in the center of the mat frame to provide a user with access to a section of exposed and unused cleaning material 15. On a first side and second side of the center cutout, a pair of cutouts is disposed for providing access to the drying portions 13 of the device. A backing member 18 is secured to the bottom surface of the mat frame 11. The backing member may be constructed of any high friction or non-slip material to increase friction between the device and a supporting surface.

Drying portions 13 are positioned on a first and second side of the exposed portion of the cleaning material 15. The drying portions are removably attached to the mat frame and are exposed to a user through frame cutouts. After a user disinfects his or her feet on the cleaning surface, they can be dried on the drying portions of the device. Each foot may be rubbed on the corresponding drying portions. Drying the feet prior to entering a dwelling reduces the tackiness and residual moisture, thereby reducing the amount of dirt cling after exiting the mat. The drying portions may be made from any soft, moisture absorbent material such as terry cloth, towel, or micro-fiber drying cloth. Additionally, the drying portions may feature designs such as the imprint of a human foot to indicate where feet should be placed.

Within the mat frame interior are a first and second roller 12, 18 that are utilized to stretch a section of cleaning material 15 across the central cut-out for use by a user. A first roller 12 is controlled by a rotational advancing means comprising a mechanical assembly or electric motor 19. The electric motor embodiment rotates the assembly using an armature 20 that connects to the first roller 12, rotating the roller to draw material 15 from a second roller 18, which is free to rotate at an opposite side of the frame 11. Control of the motor 19, and therefor control of the rollers, is provided in the form of a push button 17, which is operated by a user by depressing the button. As the rollers are advanced, a fresh section of material 15 is placed in position for use by consecutive users.

Figure 2:
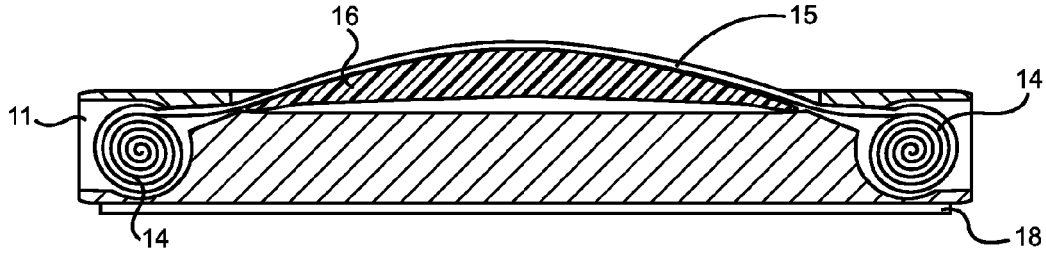
FIG. 2 shows a cross-sectional view of a shoe cleaning doormat device according to the present invention.

Referring now to FIG. 2, there is shown a side cross section view of a cleaning assembly as described by the present invention. The cleaning assembly comprises of a first 12 and second 18 roller, a length of cleaning material 15, a raised platform 16, and associated roller control means. The rollers 12, 18 are housed on opposite sides of the mat frame 11 interior, separated by the central cut-out. The roller control means comprises the foot-activated push button 17, and means for roller rotation. Two embodiments are contemplated for use with the present invention roller control means, the first and preferred method of an electric motor and associated electronics, and the second being a purely mechanical wire and cam device that requires no electrical power. For the electrical embodiment, wire routes from the push button to an electric motor or optional motor controller, which rotates an armature that extends through the first roller 12 to direct rotation thereof. The raised platform 16 provides a cushioned area for a user's foot, while also providing tension on the cleaning material 15. Along the lower surface of the mat frame is a backing member 18, which keeps the mat device in a static position while in use against a ground surface.

Positioned between the pair of rollers is a raised platform 16 having a dome shape. The top surface of the platform is upwardly convex and extends above the cutout region in the upper surface of the mat frame. A portion of the top of the platform is thus exposed above the surface of the mat frame. When a roll of cleaning material is installed within the device, the material is stretched between the pair of rollers and over the top of the raised platform. The convex surface of the platform deforms the cleaning material to provide a taught surface that is exposed above the surface of the mat frame. The surface of the cleaning material is thereby made available to a user wishing to clean and disinfect the soles of his or her feet. The slope of the convex surface of the platform, and the size of the exposed area may vary according to the size and shape of the device.

Figure 3:
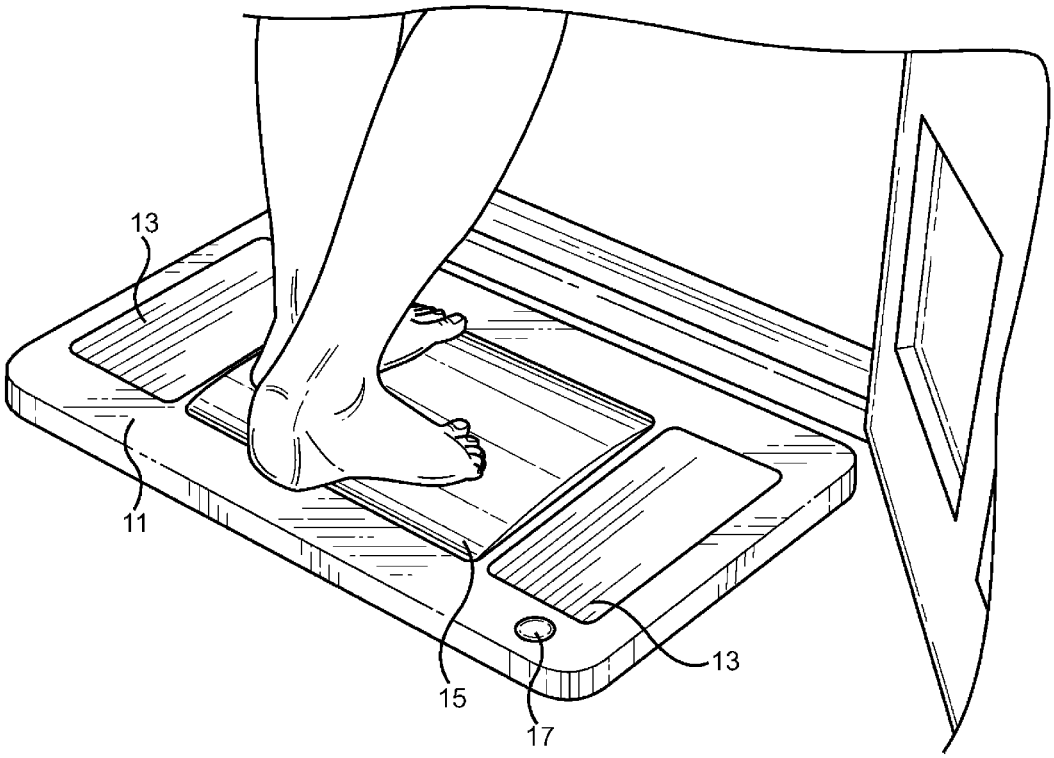
FIG. 3 shows a perspective view of a shoe cleaning doormat device according to the present invention while being used to clean an individual's feet.

Referring now to FIG. 3 there is shown a perspective view of the shoe-cleaning doormat device in use. The user stands on the exposed surface of the cleaning material and rubs his or her feet to clean and disinfect the same. After use, the exposed portion of the cleaning material may become soiled and need replacement before another user wishes to clean his or her feet. To obtain an unused portion of the roll, the user depresses the foot-operated, roller-advancing push button. In a preferred embodiment, the advancing button is electrically connected to an electric motor that drives the first roller. In an alternate embodiment, a mechanical cam and wire push control is utilized, which effectuates rotation of the rollers about a central axis. The rollers rotate while the button is being depressed and cease to rotate upon release of the same. In an alternative embodiment of the electrical actuation, depression of the advancing button by a user causes the rollers to rotate for a predetermined number of rotations. This embodiment requires a user to depress the button for only a brief period in order to advance the roll of wipes a given distance that would replace the entire expose surface of the cleaning material. In the electrically actuated embodiment, the device includes a battery source that provides power, an electric motor, a motor controller and any necessary electronic elements to control the motor rotation. The goal of rotating the cleaning material is to provide a clean surface for consecutive users, wherein no user is forced to clean their feet with a soiled section of material.

Figure 4:
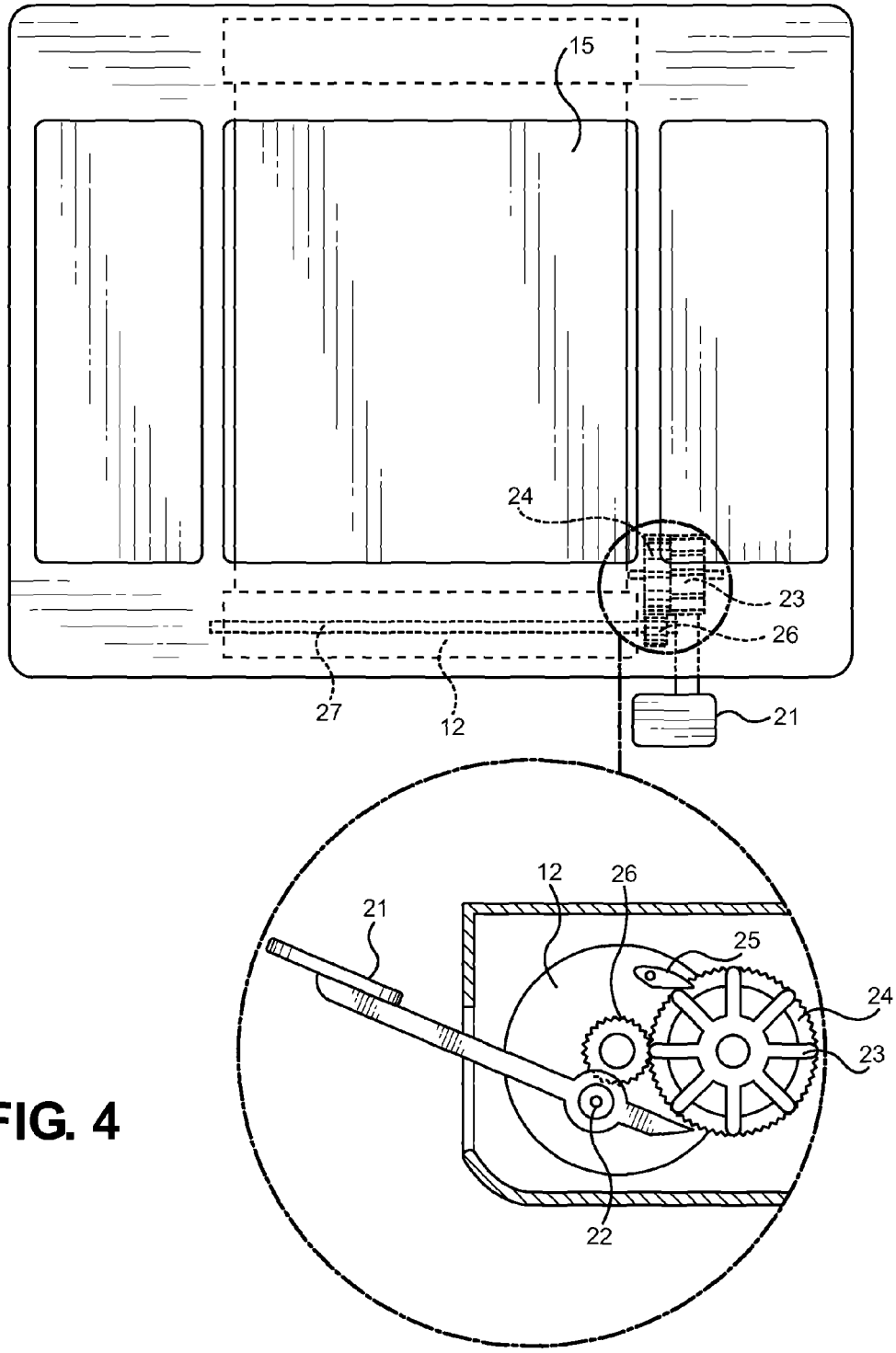
FIG. 4 shows an exploded view of the roll advancing mechanism of the shoe cleaning doormat.

Referring now to FIG. 4, there is shown a mechanically actuated embodiment of the roller advancing means. A foot pedal 21 is provided along the forward portion of the mat frame 11, wherein a user may depress and rotate the first roller 12 to advance the cleaning material 15 a given length. The foot pedal 21 is an angled lever that engages a ratchet 23 on its working end. The lever pivots about a fulcrum point 22 and is spring loaded to return the depressible end of the lever back to its original state after depression and release. The ratchet 23 is rotated a given angle via each depression of the lever 21, using a detent 25 to keep the ratchet 23 from reversing direction. The ratchet 23 is aligned with a driving gear 24 along a common shaft, which synchronizes rotates of the two devices during operation. The driving gear 24 is meshed with a second, driven gear 26 that drives a shaft 27 concentrically attached to the first roller 12. Therefore, depression of the foot pedal 21 rotates the first roller by a given angle. The described gear system provides a mechanical means to drive the first roller 12 and advance the cleaning material 15 from the second roller to the first, allowing a fresh section of material to be exposed for use by a practitioner. The gear ratio between the ratchet 23 and the rotation of the second roller will change as the material is transferred from one roll to another and their respective diameters change. The length of material drawn from the second roller per depression of the foot pedal 21 will increase as the first roller diameter increases after substantial use, as the gear ratio between the ratchet and second roller varies with their respective diameters. In operation, this embodiment requires no electrical parts to operate, and provides a functional derivative of the preferred embodiment. No power means and electronic control is necessary.

In any embodiment, the device may come in a variety of shapes and sizes. Graphic designs may be displayed on the top surface of the mat frame, cleaning material, and drying portions. The size and shape of the specific embodiment may restrict the use of some graphic designs. For example the device may be rectangular, elliptical or circular. The words "Welcome Home" may be displayed on a rectangular mat device but may not fit on the available surface area of a circular mat. Non-alphabetical designs such as footprints, flowers, and holiday themes are also contemplated for display on the mat frame.

The cleaning material is preferably a moist, disinfecting material that provides a means to clean debris and disinfect a user's foot while in operation. The material may be a cloth or paper towel material, including any thickness or consistency preferred by the user that is adaptable to be formed into rolls and dispensed in a manner consistent with the present invention.

In use an individual depresses the push button until an unused portion of the cleaning material is exposed through the center cutout of the mat frame. The moist material disinfects the soles of the feet and removes dirt from the same. A user then places the feet on the respective drying portions positioned on either side of the disinfecting wipes. The feet are rubbed repeatedly upon the drying portions to remove moisture from their soles. The user may then enter a dwelling without tracking in quantities of dirt or debris. Pets such as dogs or cats, may also utilize the device. The animal may be trained to wipe its paws upon the cleaning material prior to going inside. In this manner the spread of germs and dirt within a dwelling is reduced.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim the following:

1. A shoe-cleaning doormat device comprising:

a mat frame with an upper and lower surface, a plurality of geometrical cutouts disposed along said upper surface, a cleaning assembly housed within said mat frame and comprising a first and second roller, said first roller rotationally controlled a roller advancing means that is activated by a push button device, along with a raised platform disposed between said rollers;

a disposable roll of cleaning material removably secured between said rollers and lying above raised platform such that a portion of said material is exposed through one of said cutouts in said mat frame;

said push button being exposed through one of said cutouts in said mat frame for depression by a user;

a plurality of drying portions exposed through a plurality of said cutouts of said mat frame.

2. The device of claim 1, wherein depression of said button results in rotation of said first roller until said button is released.

3. The device of claim 1, wherein depression of said button results in rotation of said first roller for a predetermined number of rotations.

4. The device of claim 1, wherein said roller advancing means comprises an electric motor, a armature connected between said motor and said first roller, and powered via a battery source housed within said mat frame.

5. The device of claim 1, wherein said roller advancing means comprises:

a foot pedal lever, a ratchet, a driving gear, a driven gear, and a shaft;

said foot pedal lever driving said ratchet a given angle per rotation of said lever;

said ratchet being aligned with said driving gear and attached along a common shaft to synchronize rotation;

said driving gear being meshed with a driven gear to apply rotation thereto;

said driven gear being attached to said shaft;

said shaft concentrically mounted to and rotating said first roller.

6. The device of claim 5, further comprising a detent that prevent said ratchet from reversing its rotation between depressions of said lever.

7. The device of claim 5, where said foot pedal lever further comprises a fulcrum point, and a spring mechanism to return said lever to an original position after depression and release.

8. The device of claim 1, wherein said drying portions are disposed on a first and second side of said exposed cleaning material.

9. The device of claim 1, wherein said cleaning material comprises a moist, disinfecting material.

10. The device of claim 1, further comprising a friction backing member secured to said mat frame bottom surface.

11. The device of claim 1, wherein said drying portions comprise removably positioned moisture-absorbent material.

* * * * *